United States Patent [19]

Sekikawa et al.

[11] 4,024,941

[45] May 24, 1977

[54] DOT MATRIX TYPE SERIAL PRINTER

[75] Inventors: Aisuke Sekikawa; Takahiko Aragaki, both of Tokyo, Japan

[73] Assignee: Nippon Electric Company, Ltd., Tokyo, Japan

[22] Filed: Dec. 11, 1975

[21] Appl. No.: 639,853

[30] Foreign Application Priority Data

Dec. 18, 1974 Japan ..... 49-145161

[52] U.S. Cl. ..... 197/1 R; 197/53; 197/82

[51] Int. Cl.[2] ..... B41J 3/04

[58] Field of Search ..... 197/1 R, 18, 53, 82; 101/93.15–93.17; 318/685

[56] References Cited

UNITED STATES PATENTS

| | | | |
|---|---|---|---|
| 3,292,530 | 12/1966 | Martin | 197/1 R X |
| 3,566,782 | 3/1971 | Kocher | 197/53 X |
| 3,825,681 | 7/1974 | Cederberg et al. | 197/1 R X |
| 3,831,728 | 8/1974 | Woods et al. | 197/1 R |
| 3,891,077 | 6/1975 | Sauerbrunn | 197/1 R |
| 3,905,463 | 9/1975 | Boyce et al. | 197/1 R |

*Primary Examiner*—Ralph T. Rader
*Attorney, Agent, or Firm*—Sughrue, Rothwell, Mion, Zinn & Macpeak

[57] ABSTRACT

A step motor is employed as a source of power for transverse feed of the printing head assembly with a combination of a slitted rotary disc secured to the motor output shaft and a stationary detector unit provided to control the motor operation and the dot-printing head operation in precisely timed relation to each other. The rotary disc is also slotted to serve the purpose of defining for the printing head assembly a print starting position spaced a definite distance to the right from its rest position. The printer structure, including a minimum of movable component parts, is capable of forming characters without any lack of "dot" and is minimized in power consumption and noise particularly in idling operation.

3 Claims, 6 Drawing Figures

FIG. 1.
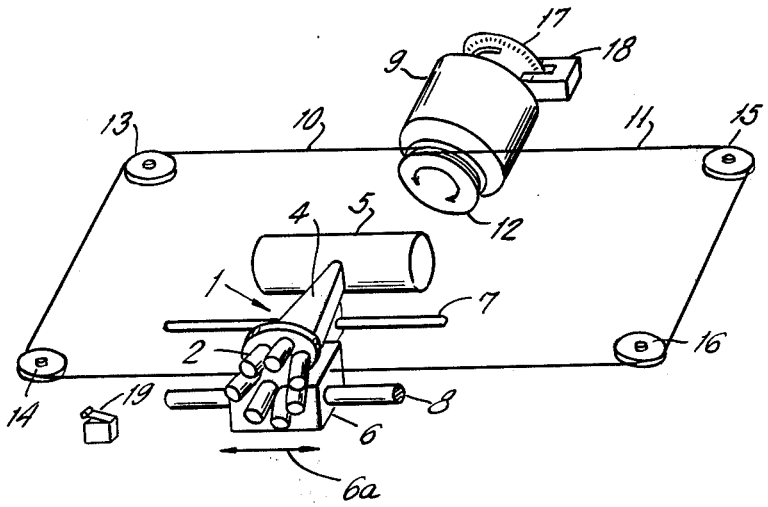
FIG. 2.
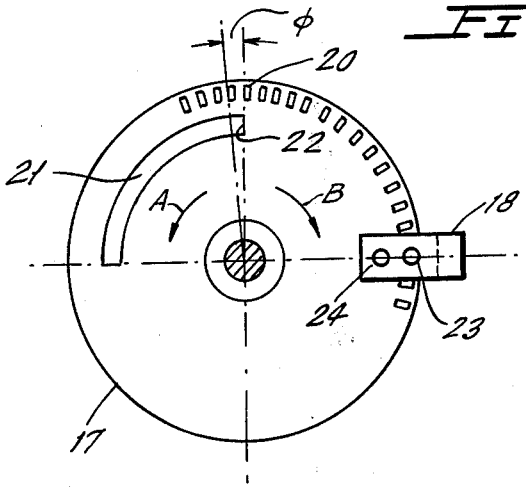
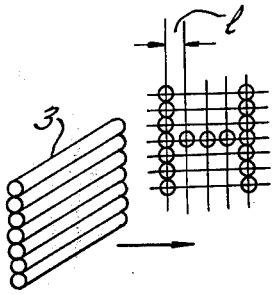
FIG. 4.
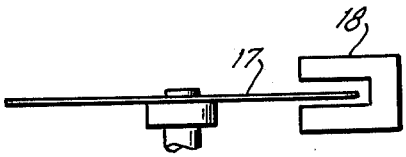
FIG. 3.

DOT MATRIX TYPE SERIAL PRINTER

BACKGROUND OF THE INVENTION

This invention relates to dot matrix type serial printing devices and more particularly to the means for controlling transverse feed and printing operation of the printing head assembly thereof.

Generally, in a serial printing device of the dot matrix type, the printing head assembly includes a set of printing elements in the form of print wires arranged in vertically aligned relation which each other and electromagnetic actuator means provided for driving the respective printing elements. In operation of the printer, the printing elements are selectively driven by the actuator means to print a dot or dots on the surface of a paper document or other printing surface each time the printing head assembly is fed transversely a pitch distance. A plurality of the dot columns consecutively printed on the printing surface are related so as to form any desired character or symbol within a definite size of dot matrix.

Heretofore, in a serial printing device, of the type described, an AC motor has ordinarily been employed as a source of power for feeding the printing head assembly transversely thereof with two clutch mechanisms associated with the AC motor for selection of the direction of movement of the printing head assembly for printing operation and restoration thereof to the rest position. The printer has also included a stationary strap member which extends in the direction of movement of the printing head assembly and is formed therein with a row of slits corresponding to respective printing positions of the printing head assembly; and, in order to detect such slits in the strap member, a photoelectric sensing unit has been mounted on the carriage of the printing head assembly. Serial printers of such known form, however, have involved various deficiencies as described below.

First, in the form of printer, the power transmission system between the power source and the printing head carriage has unavoidably been complicated, including mechanisms provided independently from each other for transverse feed control of the carriage and for controlling the print wire actuator means of the printing head assembly. Under the circumstances, the printer has included a large number of component parts, necessitating a high cost of fabrication and a large space for installation.

Further, with the previous form of serial printer, the AC motor and part of the power transmission system have been kept running even when the printer is idle or in a standby condition, thus causing a definite loss of electric power and considerable noise.

In addition, in the previous printer, since the transverse feed of the printing head assembly and the dot printing operation thereof are controlled independently from each other, as described hereinbefore, by the respective control mechanisms, any variation in rate of transverse feed of the printing head assembly has been liable to result in driving the print wires at time intervals shorter than the minimum period allowable for the print wires to properly respond to the electromagnetic drive of the wire actuator means. In such a situation, there has always been the danger that one or more of the dots required to form a character be missed, thus rendering the character formed imperfect and hardly legible.

SUMMARY OF THE INVENTION

The present invention is intended to overcome the difficulties previously encountered with serial printing devices of the dot matrix type as described avove and has for its primary object the provision of a serial printing device of the type concerned which is capable of forming characters or symbols of high quality without any lack of a dot or dots as may result from variation in the rate of transverse feed of the printing head assembly or the carriage thereof.

Another object of the present invention is to provide a dot matrix type serial printing device of the character described which is of simplified structure and reduced in cost of fabrication.

A further object of the present invention is to provide a dot matrix type serial printing device of the character described which is reduced in power consumption as well as in noise particularly when the printer is idling or in a standby condition.

To attain these objects, the present invention provides a dot matrix type serial printing device which comprises a printing head assembly including a set of vertically aligned print wires and electromagnetic acutator means therefor, a step motor operatively connected with the carriage of said printing head assembly to impart transverse feed and return movement thereto, a rotary disc fixedly mounted on the output shaft of the step motor and formed with a circularly arcuate slot and a circular row of equally spaced radial slits in concentric relation with each other around the axis of the rotary disc, said radial slits being equal in number to that of the operation steps of the step motor included in each revolution thereof, and stationary detector means including a pair of photoelectric sensors arranged across the rotary disc respectively to scan the arcuate slot and the row of radial slits as the rotary disc rotates with the step motor. The detector means are circuit-connected with the printing head assembly and the step motor in such a manner that a print starting end position is defined for the printing head assembly by one of the opposite end edges of the arcuate slot in the rotary disc as the end edge is detected by one of said photoelectric sensors and that the printing head assembly and the step motor are controlled to operate in timed relation to each other as the raidal slits in the rotary disc are successively detected by the other photoelectric sensor.

As is well known, a step motor is variable in speed or rotation by appropriate electric control means and also reversible in direction of rotation and such motor characteristics are fully utilized in the present invention to realize a highly economical, high performance dot matrix type serial printer which is extraordinarily simple in structure, including as mechanical control means only a rotary disc associated with stationary detector means, and is capable of printing characters of high quality at all times.

The above and other objects, features and advantages of the present invention will become apparent from the following description when taken in conjunction with the accompanying drawings.

BRIEF DESCRIPTION OF THE DRAWINGS

In the Drawings:

FIG. 1 is a perspective view of a preferred embodiment of the present invention, schematically illustrating the essential components thereof;

FIG. 2 is an enlarged front elevational view of the rotary disc and the detector means associated therewith, both shown in FIG. 1;

FIG. 3 is a plan view of the disc and detector means of FIG. 2;

FIG. 4 is a schematic diagram illustrating, on an enlarged scale, the arrangement of print wires and an example of dot-printed character, formed within a five by seven dot matrix;

DESCRIPTION OF THE PREFERRED EMBODIMENT

Figure 5:
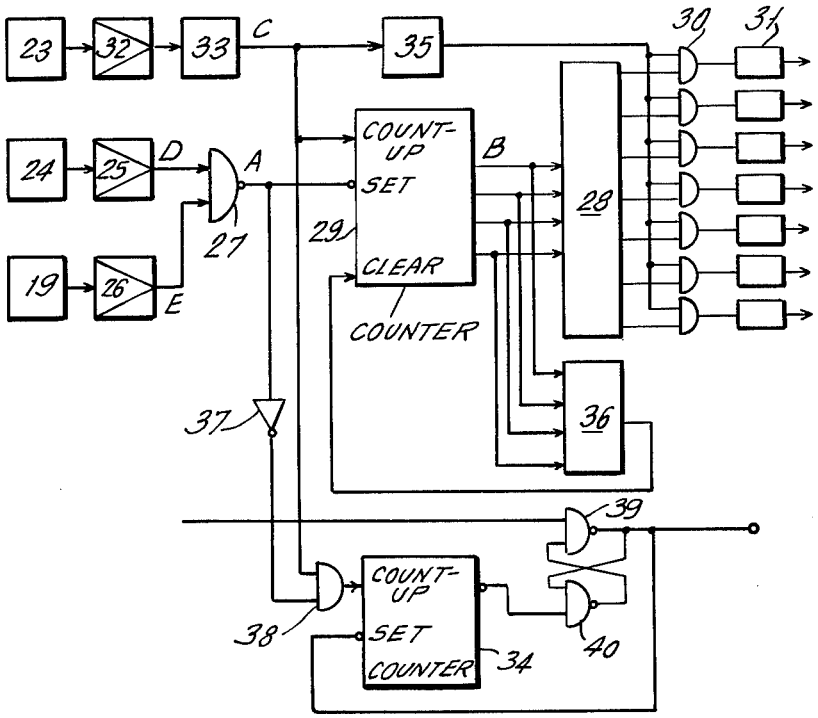
FIG. 5 is a circuit diagram illustrating the circuitry used inoperating the embodiment of FIG. 1.

Referring to FIG. 1, reference numeral 1 generally indicates a printing head assembly of the printer illustrated, which includes a plurality (seven in this embodiment) of print wires, electromagnetic print wire actuators 2 provided one for each print wire, and a wire guide section 4. Referring also to FIG. 4, the print wires 3 are guided through the wire guide section 4 so that the printing end portions of print wires 3 are held vertically aligned, as schematically illustrated in FIG. 4, in positions opposite to the platen 5 of the printer with a paper document and an inking ribbon (both not shown) interposed therebetween. Also, in FIG. 4 is illustrated an example of the alphabetic character, H, printed on the paper document by the print wires as they are selectively actuated while the printing head 1 is fed transversely in the printing direction.

Referring again to FIG. 1, the printing head 1 is mounted on a carriage 6 which is guided by guide rods 7 and 8 so as to move back and forth in front of the platen 5 in directions parallel to the axis thereof under the control of a step motor 9, as indicated by the double arrow 6a. Reference numerals 10 and 11 indicated a pair of wire ropes provided to drive the carriage 6 in respective directions. The wire ropes 10 and 11 are securely wrapped at one end around a drive pulley 12 fixedly mounted on one end of the output shaft of the step motor 9 and, extend respectively over guide pulleys 13–14 and 15–16, and have their other ends secured to the carriage 6 on the opposite sides thereof. Reference numeral 17 indicates a rotary disc fixedly mounted on the other end of the output shaft of step motor 9; 18 indicates a stationary detector unit secured to the frame body (not shown) of the printer in straddling relation to the rotary disc; and 19 indicates a limit switch provided on the printer base to serve the purpose of defining the left-hand end position of the carriage 6 and arranged so as to be operated by an appropriate dog means (not shown) secured to a bottom portion of the carriage 6.

Description will next be made in detail of the rotary disc 17 and the detector unit 18 with reference to FIGS. 2 and 3.

In FIG. 2, reference numeral 20 indicates radially aligned slits formed in the rotary disc 17 and arranged at equal intervals along a circular row adjacent the outer periphery thereof. The radial slits 20 are equal in number to that of the operation steps of step motor 9 included in each revolution thereof. Reference numeral 21 indicates a circularly arcuate elongated slot formed in the same rotary disc 17 in concentric relation with the circular row of radial slits 20. As shown, the arcuate slot 21 has one of its opposite end edges, 22, arranged in radially aligned relation with one of the opposite side edges of one of the radial slits 20. On the other hand, the stationary detector unit 18 includes a pair of photoelectric sensors 23 and 24 arranged adjacent to the rotary disc 17 and one of the photoelectric snesors, 23, is aligned to scan the row of radial slits 20 and successively detect the individual slits 20 as the rotary disc 17 rotates with the step motor 9. The other photoelectric sensor 24 is aligned to scan the arcuate slot 21 and particularly detect its end edge 22.

In operation of the printer described above, as the rotary disc 17 rotates under control of the step motor 9, the radial slits 20 formed at equal intervals in a circular arrangement in rotary disc 17, are successively detected by the photoelectric sensor 23, the output of which is fed to the control circuit, which will be described hereinafter, to serve the purpose of causing the step motor 9 to rotate stepwise at a constant rate so that the printing head carriage 6 is fed transversely stepwise at a constant rate. Incidentally, it is to be noted that the diameter of drive pulley 12 mounted on the output shaft of step motor 9 is so determined that the amount of rotation of the rotary disc 17 for each of the radial slits 20, that is, the magnitude of the pitch angle $\phi$ indicated in FIG. 2, corresponds to the pitch of dot columns in the dot matrix, within which a character or symbol is formed, that is, to the distance l indicated in FIG. 4. In the printing head assembly 1, as the step motor 9 is driven to rotate the rotary disc 17 in a direction indicated by the arrow A, the print wire actuators 2 are selectively energized each time the photoelectric sensor 23 detects one of the radial slits 20 formed in the rotary disc 17 so that dot columns are printed with a pitch distance of length l to form a character or symbol within each dot matrix, as illustrated in FIG. 4.

The printing operation proceeds as the carriage 6 is fed successively to the right, and, when the carriage reaches the right-hand end of its printing stroke, the step motor 9 is reversed in the direction of rotation under an appropriate signal to restore the carriage 6 to its rest position. It will be readily understood that the returning movement of the carriage 6 can be effected at a rate several times greater than that of carriage movement during the printing stroke by appropriate electric circuit means.

During the returning movement of the carriage 6, when it comes close to the left-hand side end of the printer, the limit switch 19 is operated to produce a signal which serves, through appropriate circuit means, to start braking the step motor 9. Under braking effect, however, the step motor 9 and rotary disc 17 continue to rotate for a while and, in the meantime, the end edge 22 of the arcuate slot 21 in the rotary disc 17 is detected by the photoelectric sensor 24. In FIG. 2, the arrow B indicates the direction of rotation of the rotary disc 17 during the return movement of carriage 6. At the instant when the slot edge 22 is detected, however, the limit switch 19 is still in the operated position, and the electric circuit decides that the carriage 6 has reached its print starting end position only upon receiving the output signal from the photoelectric sensor 24, allowing the motor 9 to continue to drive the carriage 6 further to the left. In this manner, the carriage 6 comes to stop only when it has been driven past its print starting end position by a distance several times as large as the character spacing. As used herein, the term "print starting end position" means the carriage position where the actual printing operation is started for each line of characters. It is to be noted that the length of the arcuate slot 21 in the rotary disc 17 is determined so as to be kept effectively sensed by the photoelectric sensor 24 even after the carriage 6 has been completely restored. Incidentally, the rest position or the extreme left-hand end position of the carriage 6, which is deliberately spaced leftward from the print starting end position thereof, as described herein, is intended to prevent the printed data in the starting end portion of the preceding line from being concealed from operator by the printing head assembly and particularly the wire guide section 4 thereof.

In starting the printing head carraige from its rest position for the next line of print, initially the step motor 9 and rotary disc 17 are started by appropriate electric circuit means to rotate in the printing direction, i.e., in the direction indicated in FIG. 2 by the arrow A and, when they have turned through an angle corresponding to the sum of a predetermined number of character spacings, the photoelectric sensor 24 of the detector unit 18 detects the trailing end edge 22 of the arcuate slot 21, formed in the rotary disc 17 to define the print starting end position of the printing head assembly 1 and causes the latter to start printing operation. Specifically, the printing operation is acutally started when one of the radial slits 20 in the rotary disc is detected by the photoelectric sensor 23 immediately after the end edge 22 of the arcuate slot 21 has been detected by the photoelectric sensor 24. Once the printing operation has actually been started in this manner, the printing head assembly and the step motor operate continuously in precisely timed relation to each other under the control of the row of radial slits 20, as described hereinbefore.

Electric circuit means employed with the printer described for effecting printing operation and transverse feed movement of the printing heas assembly will be outlined below with reference to FIGS. 5 and 6, which illustrated the general arrangement of the printer circuit and the signal-time chart thereof, respectively.

At the start of the printing cycle of the printing head assembly, the signal from the photoelectric sensor 24 and that from the limit switch 19, provided to detect the left-hand end position of the carriage 6, are fed through respective shaping cirucits 25 and 26 into a NAND gate 27 to form a print range signal A, which determines a range of line within which characters can be actually printed. This signal A is fed to the SET terminal of an address counter 29 provided to produce an address signal B, which is fed to a character generator 28. Outside the print range as determined by the signal A, however, the address designation to the character generator 28 remains unchanged and no printing operation is effected; and only when the print range signal A rise "high", the address counter 29 starts to take count of each pulse of print timing signal C as it is fed thereto and printing operation is starting to print dot columns as print wire actuator circuits 31 connected with the character generator 28 through respective AND gates 30 are selectively energized. The print timing signal C appears at the output of a differentiating circuit 33, which is fed with the output of the photoelectric sensor 23 through a shaping circuit 32 as the sensor 23 detects radial slits 20 formed in the rotary disc 17.

The return stroke of the printing head assembly is started upon reception of a return signal CR and subsequently, when the sensor 24 detects the end edge 22 of the arcuate slot 21 in the rotary disc 17, the print range signal A becomes "low" or off indicating that the printing head assembly has reached its print starting end position. On this occasion, however, a counter 34 arranged separate from the address counter 29 takes count for a while of the pulses of print timing signal C to caus the printing head assembly to continue its return movement until the assembly comes to a halt in a predetermined position spaced to the leftward of its print starting end position by a distance corresponding to the sum of a number of character spacings.

Figure 6:
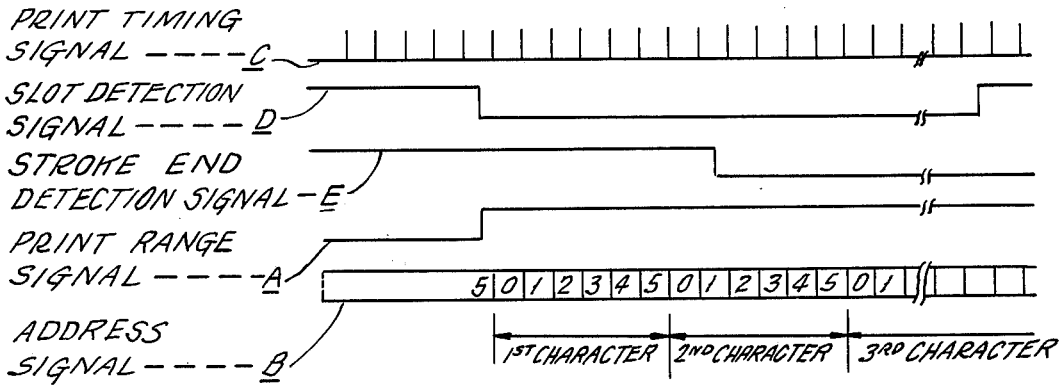
FIG. 6 is a signal-time chart of the circuit shown in FIG. 5.

In FIGS. 5 and 6, reference character D designates the output signal from the photoelectric sensor 24 scanning the arcuate slot 21 in the rotary disc 17 to detect its end edge 22; and E designates the output signal from the stroke end detecting limit switch 19. In the circuit of FIG. 5, both counters 29 and 34 are binary counters of the radix-16 type; and reference numeral 35 indicates a monostable multivibrator; 36, a decoder; 37, an inverter; 38, an AND gate; 39 and 40, cross-coupled NAND gates. The respective functions of these circuit components will be apparent to those skilled in the art and a detailed description thereof is omitted herein for purposes of brevity.

To summarize, the serial printing device of the invention is particularly simplified in structure with a minimum of movable component parts, including, among others, a step motor as a source of power for transverse feed of the printing head assembly and a combination of a rotary disc secured to the output shaft of the step motor with a stationary detector unit as means for controlling the motor operation and the dot-printing operation of the printing head assembly and is capable of forming clearly legible characters or symbols without any lack of a dot or dots. Among other advantages are reduced cost of fabrication and minimized power consumption and noise particularly in idling operation.

Though but one preferred embodiment of the invention has been shown and described, it will be apparent to those skilled in the art that many changes and modifications may be made therein without departing from the spirit of the invention or the scope of the appended claims.

What is claimed is:

1. A dot matrix type serial printing device comprising:

a movably mounted carriage; a printing head assembly on said carriage, said head including a set of linearly aligned print wires and electromagnetic actuator means for driving the print wires; a step motor having an output shaft and operatively connected with said carriage to impart a transverse feed and a return movement to said carriage; a rotary disc fixedly mounted on the output shaft of said motor and formed with a circularly arcuate slot with opposite end edges therein and a circular row of equally spaced radially aligned slits, said slot and said row being in concentric relation with each other around the axis of said rotary disc, said radial slits being equal in number to that of the operation steps of said step motor in each revolution thereof; stationary detector means including first and second photoelectric sensors arranged with respect to said rotary disc to respectively scan said arcuate slot and said row of slits as said step motor rotates said rotary disc; said detector means generating a signal defining a print starting end position for said printing head assembly by detecting one of the opposite end edges of said arcuate slot in said rotary disc as said end edge is detected by the first of said photoelectric sensors and wherein said printing head assembly and step motor are controlled to operate in timed relation to each other as said radial slits in said rotary disc are successively detected by the second photoelectric sensor.

2. The apparatus of claom 1, wherein said first sensor detecting said slot generates a first signal when said is passing the first sensor and a second signal when the slot is displaced from the first sensor;

said detector means including means coupled to said first and second sensors and responsive to the passage of one end of said slot and the passage of the next slit detected gy said second sensor for enabling actuation of said printing head assembly.

3. The apparatus of claim 1, including means responsive to a return signal for driving said motor to return the carriage towards the starting position;

meas responsive to said opposite end edge of said slot for maintaining said motor energized to move the head assembly a predetermined distance beyond the first print position to enable the previously printed line to be viewed without any obstruction.

* * * * *